US005869198A

United States Patent [19]

Erne et al.

[11] Patent Number: 5,869,198

[45] Date of Patent: Feb. 9, 1999

[54] PROCESS FOR MULTI-LAYER COATING

[75] Inventors: Marcus Erne, Ennepetal; Jürgen Döbert, Sprockhövel; Klausjörg Klein, Wuppertal; Matthias Kimpel, Schwelm, all of Germany

[73] Assignee: Herberts Gesellschaft Mit Beschrankter Haftung, Wuppertal, Germany

[21] Appl. No.: 930,518

[22] PCT Filed: Mar. 26, 1996

[86] PCT No.: PCT/EP96/01316

§ 371 Date: Sep. 30, 1997

§ 102(e) Date: Sep. 30, 1997

[87] PCT Pub. No.: WO96/30131

PCT Pub. Date: Oct. 3, 1996

[30] Foreign Application Priority Data

Mar. 31, 1995 [DE] Germany ..... 195 12 017.5

[51] Int. Cl.[6] ..... C25D 13/06

[52] U.S. Cl. ..... 428/626; 428/416; 204/488; 427/409

[58] Field of Search ..... 204/486, 487, 204/488; 428/626, 416; 427/409

[56] References Cited

U.S. PATENT DOCUMENTS

| | | | |
|---|---|---|---|
| 4,139,672 | 2/1979 | Ozawa | 428/323 |
| 4,375,498 | 3/1983 | Le Minez et al. | 204/488 |
| 4,761,212 | 8/1988 | Watanabe et al. | 204/488 |
| 4,851,460 | 7/1989 | Stranghoner | 523/407 |
| 4,865,704 | 9/1989 | Saatweber | 204/181.7 |
| 5,015,688 | 5/1991 | Bederke | 524/600 |
| 5,109,040 | 4/1992 | Honig | 523/411 |
| 5,229,210 | 7/1993 | Kasukawa | 204/181.7 |
| 5,328,579 | 7/1994 | Kasukawa | 204/181.7 |
| 5,389,406 | 2/1995 | Doebler | 204/181.1 |
| 5,395,659 | 3/1995 | Graf | 427/409 |
| 5,416,136 | 5/1995 | Konzmann | 523/414 |
| 5,473,032 | 12/1995 | Bederke | 524/901 |
| 5,552,184 | 9/1996 | Klostermann | 427/284 |
| 5,552,496 | 9/1996 | Vogt-Birnbrich | 525/440 |
| 5,612,095 | 3/1997 | Brock | 427/409 |
| 5,635,559 | 6/1997 | Brock | 524/839 |
| 5,661,199 | 8/1997 | Bederke | 523/206 |

FOREIGN PATENT DOCUMENTS

| | | |
|---|---|---|
| 0 265 363 | 4/1988 | European Pat. Off. . |
| 0 402 181 | 12/1990 | European Pat. Off. . |
| 0 595 186 | 5/1994 | European Pat. Off. . |
| 2 335 270 | 12/1976 | France . |

*Primary Examiner*—Kathryn L. Gorgos
*Assistant Examiner*—Kishor Mayekar
*Attorney, Agent, or Firm*—Cushman Darby & Cushman IP Group of Pillsbury Madison & Sutro, LLP

[57] ABSTRACT

A process for the multi-layer coating of electrically conductive substrates by the electrophoretic deposition of a first coating layer comprising an electrophoretically depositable aqueous coating medium, to which a second coating layer, comprising a first color- and/or effect-imparting base lacquer coating medium, is applied wet-into-wet, and the first and second coating layers thus obtained are stoved jointly, whereupon a third coating layer comprising a second color- and/or effect-imparting base lacquer coating medium is applied and a fourth coating layer comprising a clear lacquer coating medium is applied wet-into-wet thereto and the third and fourth coating layers are stoved jointly, wherein the total dry coat thickness of the second and third coating layers produced from the base lacquer coating media is between 15 and 40 $\mu$m and the proportion of the second coating layer is between 20 and 50% of the total dry coat thickness of the second and third coating layers.

10 Claims, No Drawings

PROCESS FOR MULTI-LAYER COATING

This application is the national phase of international application PCT/EP96/01316, filed Mar. 26, 1996 which designated the U.S.

FIELD OF THE INVENTION

This invention relates to a process for the production of multi-layer coatings.

BACKGROUND OF THE INVENTION

Current mass production automobile coatings consist for the most part of a base lacquer/clear lacquer covering coating which is applied to a body which has been electrophoretically primed and coated with primer surfacer. In the course of this procedure, the base lacquer and the clear lacquer are preferably applied wet-into-wet, i.e. after a ventilation period, optionally with heating, and after the subsequent application of a clear lacquer, the base lacquer is stoved jointly with the latter. Processes which serve to reduce further stoving steps have also become known, in which the electrophoretically deposited primer coat and the primer surfacer coat are applied by the wet-into-wet method, as described in DE-A-41 26 476 or EP-A-0 595 186 for example. The primer surfacer coats have to be applied to give a dry film thickness of 30 $\mu$m or more, which is customary for primer surfacer lacquers.

The procedure according to DE-A-41 26 476 and EP-A-0 595 186 is subject to restrictions as regards the composition of the primer surfacer coats which are applied wet-into-wet, i.e. it is not possible to use any desired primer surfacer coating media. Furthermore, the properties of the electro-dip lacquer material and of the primer surfacer material have to be matched to each other.

It is known from EP-A-0 265 363 that a previously stoved, cataphoretically deposited primer coat can be provided with a two-coat base lacquer/clear lacquer covering coat by the wet-into-wet method. The primer surfacer coat is dispensed with. An effect which is problematical, however, is that stone impact damage to motor vehicles coated by this process is particularly conspicuous, since on stone impact the primer coat is exposed due to the debonding of the covering lacquer. Whilst protection from corrosion is still in fact ensured, the visual impression cannot be tolerated, however.

For reasons of rationalisation and savings in material, there is a desire for a reduction in the coating thickness of the lacquer structure for the coating of motor vehicles, but without this resulting in significant losses in the overall level of properties thereof.

SUMMARY OF THE INVENTION

The object of this invention is to provide a process for the production of multi-layer coatings, particularly motor vehicle coatings, which have an overall level of properties comparable with the prior art but with a reduced coating thickness of the lacquer structure as a whole, which process minimises the expense of matching the individual lacquer coats to each other and which can be carried out with as few stoving steps as possible.

This object has surprisingly been achieved by a process for the multi-layer coating of electrically conductive substrates by the electrophoretic deposition of a first coating layer comprising an electrophoretically depositable aqueous coating medium, and the subsequent application of further coating layers, which is characterised in that a second coating layer comprising a first colour- and/or effect-imparting base lacquer coating medium is applied wet-into-wet to the first coating layer obtained by electrophoretic deposition, and the first and second coating layers thus obtained are stoved jointly, whereupon a third coating layer comprising a second colour- and/or effect-imparting base lacquer coating medium is applied and a fourth coating layer comprising a clear lacquer coating medium is applied wet-into-wet thereto and the third and fourth coating layers are stoved jointly, wherein the total dry coat thickness (the sum of the coat thicknesses) of the second and third coating layers produced from the base lacquer coating media is between 15 and 40 $\mu$m, preferably between 20 and 35 $\mu$m, and the proportion of the second coating layer is between 20 and 50%, preferably between 25 and 40%, of the total dry coat thickness of the second and third coating layers.

The process according to the invention makes it possible to apply a base lacquer coating medium directly to the electrophoretically deposited first coating layer, which has not yet been stoved, and to stove this base lacquer coating medium jointly with the electrophoretically deposited coating layer, wherein primer surfacer coats or other intermediate coats are dispensed with.

The process according to the invention is preferably conducted so that the joint stoving of the third and fourth coatings is effected at a temperature which is the same as the stoving temperature which prevails during the joint stoving of the first and second coating layers, or which is most preferably below this.

DETAILED DESCRIPTION OF THE INVENTION

In the process according to the invention, anodically or cathodically depositable electro-dip lacquers (EDLs) which are known in the art, and which are subject to no particular restriction, can be used for the production of the first coating layer, namely a primer coat.

These are aqueous coating media with a solids content of 10 to 20% by weight, for example. The solids content is formed from customary binder vehicles for electro-dip coating, which contain ionic groups or groups which can be converted into ionic groups, and which contain groups capable of chemical crosslinking, and from pigments, extenders and/or customary additives. The ionic groups or groups which can be converted into ionic groups may be anionic groups or groups which can be converted into anionic groups, e.g. acidic groups such as —COOH groups, or cationic groups or groups which can be converted into cationic groups, e.g. basic groups such as amino groups, ammonium groups e.g. quaternary ammonium groups, or phosphonium and/or sulphonium groups. Basic groups which contain nitrogen are particularly preferred. These groups may be present in quaternarised form, or they are at least partially converted into ionic groups with a customary neutralising agent such as an acid, e.g. an organic monocarboxylic acid, such as formic acid or acetic acid for example.

Examples of anodically depositable electro-dip lacquer binder vehicles and lacquers (ADLs) which contain ionic groups and which can be used in the process according to the invention are described in DE-A-28 24 418. These are binder vehicles based on polyesters, epoxy resins, poly (meth)acrylates, maleic oils or polybutadiene oils with a weight average molecular weight of 300 to 10,000 and an acid number of 35 to 300 mg KOH/g for example. The binder vehicles contain —COOH, —$SO_3H$ and/or $PO_3H_2$ groups. The resins can be converted into the aqueous phase after neutralisation of at least part of the acidic groups. The lacquers may also contain customary crosslinking agents, e.g. triazine resins, crosslinking agents which contain groups capable of transesterification, or blocked polyisocyanates.

However, cathodic electro-dip lacquers (CDLs) based on cationic or basic binder vehicles are preferably used in the process according to the invention. Examples of basic resins such as these include resins containing primary, secondary or tertiary amino groups, the amine numbers of which are 20 to 250 mg KOH/g, for example. The weight average molecular weight (Mw) of the base resins is preferably 300 to 10,000. Examples of base resins such as these include amino(meth)acrylate resins, aminoepoxide resins, aminoepoxide resins containing terminal double bonds, aminoepoxide resins containing primary OH groups, aminopolyurethane resins, polybutadiene resins containing amino groups, or modified epoxy resin-carbon dioxide-amine reaction products. These base resins may be self-crosslinking or may be used in admixture with known crosslinking agents. Examples of crosslinking agents such as these include amino plastic resins, blocked polyisocyanates, crosslinking agents containing terminal double bonds, polyepoxide compounds, or crosslinking agents which contain groups capable of transesterification.

Examples of base resins and crosslinking agents which can be used in cathodic dip lacquer (CDL) baths are described in EP-A-0 082 291, EP-A-0 234 395, EP-A-0 227 975, EP-A-0 178 531, EP-A-0 333 327, EP-A-0 310 971, EP-A-0 456 270, U.S. Pat. No. 3,922,253, EP-A-0 261 385, EP-A-0 245 786, DE-A-33 24 211, EP-A-0 414 199, and EP-A-0 476 514. These resins may be used on their own or in admixture. What are termed "non-yellowing" CDL systems are preferably used; these prevent yellowing or discoloration of the multi-layer coating on stoving. Examples of these include CDL systems which crosslink by means of specially selected blocked polyisocyanates, such as those described in EP-A-0 265 363 for example.

In addition to the base resins and to the crosslinking agents which are optionally present, the electro-dip lacquer (EDL) coating medium may contain pigments, extenders and/or customary lacquer additives. The usual inorganic and/or organic pigments and extenders are suitable as pigments and extenders. Examples include carbon black, titanium dioxide, iron oxide, kaolin, french chalk or silica.

The pigments can be dispersed to form pigment pastes, e.g. using known paste resins. Resins such as these are familiar to one skilled in the art. Examples of paste resins which can be used in CDL baths are described in EP-A-0 183 025 and EP-A-0 469 497.

Possible additives include the usual additives for EDL coating media. Examples thereof include wetting agents, neutralising agents, levelling agents, catalysts, anti-foaming agents, solvents, and particularly light stabilisers, optionally in combination with anti-oxidants.

Colour and/or effect-imparting base lacquer coating media which are known in the art, such as those which are used for the production of base lacquer/clear lacquer two-layer coatings and a large number of which are known from the patent literature for example, are used in the process according to the invention for the production of the second and third coating layers.

The base lacquers which can be used according to the invention for the production of the second and third coating layers may be physically drying or may be crosslinkable by the formation of covalent bonds. The base lacquers which crosslink by the formation of covalent bonds may be self-crosslinking or externally crosslinkable systems.

The colour- and/or effect-imparting base lacquers used in the process according to the invention are liquid coating media. They may be single- or multi-component coating media; single-component media are preferred. They may be systems based on organic solvents, but are preferably aqueous base lacquers, the binder vehicle systems of which are stabilised in a suitable manner, e.g. anionically, cationically or non-ionically.

The base lacquer coating media which can be used in the process according to the invention for the production of the second and third coating layers are customary lacquer systems which contain one or more customary base resins as film-forming binder vehicles. If the base resins are not self-crosslinking or self-drying, they may also optionally contain crosslinking agents. Neither the base resin component nor the crosslinking component are subject to any restriction. Polyester, polyurethane and/or (meth)acrylic copolymer resins can be used as film-forming binder vehicles (base resins), for example. The preferred aqueous base lacquers preferably contain polyurethane resins, most preferably in a content of at least 15% by weight with respect to the solid resin content of the aqueous base lacquer. The selection of the crosslinking agents which are optionally contained is not critical; it depends on the functionality of the base resins, i.e. the crosslinking agents are selected so that they comprise a reactive functionality which is complementary to that of the base resins. Examples of complementary functionalities such as these between the base resin and the crosslinking agent include: hydroxyl/methylol ether, hydroxyl/free isocyanate, hydroxyl/blocked isocyanate, and caboxyl/epoxide. Provided that they are compatible with each other, a plurality of complementary functionalities such as these may be present together in one lacquer. The crosslinking agents which are optionally contained in the base lacquers may be present individually or in admixture.

In addition to the usual physically drying and/or chemically crosslinking binder vehicles, the base lacquers which are used in the process according to the invention contain inorganic and/or organic coloured and/or effect pigments, such as titanium dioxide, iron oxide pigments, carbon black, azo pigments, phthalocyanine pigments, metallic pigments e.g. those comprising titanium, aluminium or copper, interference pigments such as aluminium coated with titanium dioxide or coated mica for example, graphite effect pigments, lamellar iron oxide or lamellar copper phthalocyanine pigments, for example.

In addition, the base lacquers may contain customary lacquer auxiliary materials, such as extenders, catalysts, levelling agents or anti-cratering agents, and particularly light stabilisers in combination with anti-oxidants.

Examples of solvent-based base lacquer systems which can be used in the process according to the invention are to be found in DE-A-37 15 254, DE-A-39 13 001, DE-A-41 15 948, DE-A-42 18 106, EP-A-0 289 997 and WO-91 00 895.

Examples of aqueous base lacquer systems which are preferably used in the base lacquer coating media according to the invention are to be found in DE-A-29 26 584, DE-A-36 28 124, DE-A-38 41 540, DE-A-39 03 804, DE-A-39 15 459, DE-A-40 01 841, DE-A-40 09 857, DE-A-40 11 633, DE-A-41 07 136, DE-A-41 22 266, EP-A-0 089 497, EP-A-0 226 171, EP-A-0 228 003, EP-A-0 287 144, EP-A-0 297 576, EP-A-0 301 300, EP-A-0 353 797, EP-A-0 354 261, EP-A-0 401 565, EP-A-0 424 705, EP-A-0 422 357, EP-A-0 512 524 and EP-A-0 584 818.

In this connection, different base lacquers can be used for the second and third coating layers which are produced by the process according to the invention. Similar base lacquers are preferably used, however, and the same base lacquer is most preferably used, as explained below.

For example, a solvent-based base lacquer or preferably a water-thinnable base lacquer can be used for the production of the second coating layer. The same selection option exists for the third coating layer, but it is preferable to use either a solvent-based base lacquer or an aqueous base lacquer for each of these two coating layers. It is most preferable if the solid resin composition of the base lacquers used for the production of the second and third coating layers is substantially the same, i.e. if it comprises a solid resin composition which is qualitatively the same (the same binder vehicles and optionally crosslinking agents are present), and comprises a quantitative solid resin composition which has a range of variation of less than 30%, preferably less than 20%, most preferably less than 15%, with respect in each case to the relative proportion by weight of the individual binder vehicles and of the crosslinking agents which may optionally be present. It is preferable in addition that the base lacquer used for the production of the second coating layer has a colour tone which approximates to that of the base lacquer used for the production of the third coating layer, or is most preferably identical thereto. In the context of the present invention, the expression "colour tones which approximate to each other" is preferably understood to mean that the colour difference, consisting of the difference in brightness, difference in colour shade and difference in colour saturation, which exists between the colour tones of the second and third coating layers, as determined in each case for a covering coating and at a measuring geometry of (45°/0°), is not greater than n times the $\Delta E^*$(CIELAB) value. In this respect, the $\Delta E^*$(CIELAB) reference value is that value which occurs in the CIE x,y plot (chromaticity plot), which is familiar to one skilled in the art following DIN 6175, for the colour tone of the third coating layer, wherein the following equation applies:

$n \leqq 90$ in the range of the CIE x,y plot characterised by $\Delta E^*=0.3$, $n \leqq 50$ in the range of the CIE x,y plot characterised by $\Delta E^*=0.5$, $n \leqq 40$ in the range of the CIE x,y plot characterised by $\Delta E^*=0.7$, $n \leqq 30$ in the range of the CIE x,y plot characterised by $\Delta E^*=0.9$.

In the case of the aqueous base lacquers which are preferably used for the production of the second and third coating layers, the process according to the invention can be carried out as a special embodiment. In this procedure, recycled overspray from the circulating water of the spray booth, which arises during the production of the third coating layer, is used for the production of the second coating layer. A recycled aqueous base lacquer such as this can be recovered by ultrafiltration from the circulating water of the spray booth, for example. A multiplicity of colour tones is generally processed in mass production coating operations. Therefore, the procedure employed is preferably such that the aqueous base lacquers used for the production of the third coating layer are amalgamated to form suitable colour, so that one or more recycled aqueous base lacquers are recovered which each exhibit a mixed colour tone. The amalgamation procedure to form colour groups during the production of the third coating layer can be conducted, for example, so that the mixed colour tones which are formed of the recycled aqueous base lacquers which are subsequently used for the production of the second coating layer and the colour tone of the water-base lacquer used in each case for the production of the third coating layer approximate to each other. This approximation is to be understood, for example, as exactly that which was explained above for the colour difference.

It is self-evident that, as regards the composition of the colour groups, it is additionally preferred that the differently pigmented aqueous base lacquers comprise a substantially identical solid resin composition, i.e. that they preferably have what is qualitatively the same solid resin composition and their quantitative resin composition only exhibits a range of variation of the relative proportions by weight of the individual binder vehicles plus the crosslinking agents which are optionally present of less than 30%, preferably less than 20%, most preferably less than 15%.

In principle, all known or transparent pigmented coating media are suitable for the production of the fourth coating layer. These may be single- or multi-component clear lacquer coating media. They may be solvent-free (liquid or as a clear powder coating), may comprise solvent-based systems, or may comprise water-thinnable clear lacquers, the binder vehicle systems of which are stabilised in a suitable manner, e.g. anionically, cationically or non-ionically. The water-thinnable clear lacquer systems may be water-soluble systems or systems which can be dispersed in water, particularly emulsion systems. The clear lacquer coating media harden on stoving by the formation of covalent bonds as a result of chemical crosslinking.

The clear lacquers which can be used in the process according to the invention are customary clear lacquer coating media which contain one or more customary base resins as film-forming binder vehicles. If the base resins are not self-crosslinking, they may also optionally contain crosslinking agents. Neither the base resin component nor the crosslinking component are subject to any restriction. For example, polyester, polyurethane and/or poly(meth) acrylate resins can be used as film-forming binder vehicles (base resins). The selection of the crosslinking agents which are optionally contained is not critical; it depends on the functionality of the base resins, i.e. the crosslinking agents are selected so that they comprise a reactive functionality which is complementary to that of the base resins. Examples of complementary functionalities such as these between the base resin and the crosslinking agent include: carboxyl/epoxide, hydroxyl directly bonded to carbon or silicon/methylol ether, hydroxyl directly bonded to carbon or silicon/free isocyanate, hydroxyl directly bonded to carbon or silicon/blocked isocyanate, or (meth)acryloyl/acidic CH group. In this connection, the term "hydroxyl groups directly bonded to silicon" is also to be understood as comprising latent silanol groups, such as alkoxysilane groups for example. Provided that they are compatible with each other, a plurality of complementary functionalities such as these may be present together in one lacquer. The crosslinking agents which are optionally contained in the base lacquers may be present individually or in admixture.

In addition to chemically crosslinking binder vehicles and optionally crosslinking agents, the clear lacquers used in the process according to the invention may contain customary lacquer auxiliary materials, such as catalysts or levelling agents, and particularly light stabilisers, optionally in combination with anti-oxidants.

Examples of single- (1-C) and two-component (2-C), non-aqueous clear lacquer systems which can be used as a clear lacquer in the process according to the invention are to be found in DE-A-38 26 693, DE-A-40 17 075, DE-A-41 24 167, DE-A-41 33 704, DE-A-42 04 518, DE-A-42 04 611, EP-A-0 257 513, EP-A-0 408 858, EP-A-0 523 267, EP-A-0 557 822 and WO-92 11 327.

Examples of single- (1-C) and two-component (2-C), aqueous clear lacquer systems which can be used as a clear lacquer in the process according to the invention are to be found in DE-A-39 10 829, DE-A-40 09 931, DE-A-40 09 932, DE-A-41 01 696, DE-A-41 32 430, DE-A-41 34 290, DE-A-42 03 510, EP-A-0 365 098, EP-A-0 365 775, EP-A-0 496 079 and EP-A-0 546 640.

Examples of clear powder coating systems which can be used as a clear lacquer in the process according to the invention are to be found in EP-A-0 509 392, EP-A-0 509 393, EP-A-0 522 648, EP-A-0 544 206, EP-A-0 555 705, DE-A-42 22 194 and DE-A42 27 580.

Electrically conductive materials, such as metals for example, are suitable as the substrate for the process according to the invention. Substrates which are particularly suitable are automobile bodies or parts thereof, for example. These may consist of pretreated metal or of metal which has not been pretreated, of metal which is provided with an electrically conductive layer, or of an electrically conductive plastics material or a plastics material which has been provided with an electrically conductive layer. For example, an electrically conductive layer may have been formed on metal substrates by the electrophoretic deposition and stoving of an appropriate coating. The first coating layer is applied electrophoretically in the usual manner to such substrates, particularly in the form of an anti-corrosion primer coat, to give a dry coat thickness of 15 to 35 μm which is customary for EDL primer coats. In the particular case of pre-coated substrates, multi-layer coatings are obtained which comprise more than the four coating layers which are produced according to the invention.

The electro-dip lacquer coat which is first applied in the process according to the invention is nevertheless described below as the first coating layer.

The first coating layer produced according to the invention is rinsed with an aqueous solution or water in order to remove surplus, non-adherent proportions of lacquer, and thereafter, before the wet-into-wet application of the second coating layer comprising a first colour- and/or effect-imparting base lacquer or comprising a recycled base lacquer which has a mixed colour tone, it is freed from adhering moisture. This is effected, for example, by ventilation with air. It may be effected by IR radiation and/or by an air current, which is optionally heated, and which is passed over the substrate. The temperature of the air current may be from room temperature to 120° C., for example. It is preferably above 80° C. No crosslinking of the electro-dip lacquer film should occur in the course of this procedure.

The second coating layer, comprising the first colour- and/or effect-imparting base lacquer, is applied by spraying to the substrate with an uncrosslinked EDL coat which is thus obtained. Examples of suitable spray application methods include compressed air spraying, airless spraying or electrostatic (ESTA) high-speed rotation spraying. After a short ventilation period, optionally at elevated temperatures up to 80° C., the workpiece with the two coating layers is stoved, at temperatures between 130° and 190° C. for example, preferably between 140° and 180° C. for example. After stoving, the surface may optionally be subsequently treated, e.g. by rubbing down in order to repair defects.

According to the invention, this is followed by the spray application of the third coating layer comprising the colour- and/or effect-imparting base lacquer, for example by compressed air spraying, airless spraying or ESTA high speed rotation spraying, wherein it is essential to the invention that the total dry coat thickness of the second and third coating layers is between 15 and 40 μm, preferably between 20 and 35 μm, wherein the proportion of the first colour- and/or effect-imparting coating layer is between 20 and 50%, preferably between 25 and 40%, of the total dry coat thickness of the coating layers produced from the colour- and/or effect-imparting coating media. For example, the dry coat thickness of the second coating layer is between 5 and 15 μm and that of the third coating layer is usually 10 to 30 μm for base lacquer coats. Without being bound to any theory, it is assumed that the low coat thickness of the second coating layer makes it possible to carry out the process according to the invention without any special matching between the electro-dip lacquer used for the production of the first coating layer and the base lacquer used for the production of the second coating layer.

The application of the third coating layer is followed, after a short ventilation period e.g. at 20° to 80° C., by the application of the clear lacquer by the wet-into-wet method.

The fourth coating layer is overcoated as a customary liquid clear lacquer or clear powder coating (in the latter case a dry-into-wet application is employed), to give a dry coat thickness which is customary for clear lacquer coats and which is preferably 30 to 80 μm, and is stoved jointly with the third coating layer. The stoving temperature is preferably the same as the stoving temperature which prevails for the joint stoving of the first and second coating layers, or is most preferably below this. For example, the stoving temperature for the joint stoving of the third and fourth coating layers is up to 160° C., preferably less than 140° C.

The base lacquer coating media according to the invention enables four-layer and also multi-layer coatings to be produced, particularly motor vehicle coatings which have a reduced overall thickness and a comparable overall level of properties in relation to the prior art which includes primer surfacer coats and/or other intermediate coats. Only two stoving steps are necessary. Matching of the coating media used for the production of the first and second coating layers to each other is not necessary. The possibility exists, particularly when aqueous base lacquers are used in the process according to the invention, of recycling the overspray by using concentrated overspray in the production of the second coating layer.

We claim:

1. A process for the multi-layer coating of electrically conductive substrates by the electrophoretic deposition of a first coating layer comprising an electrophoretically depositable aqueous coating medium, and the subsequent application of further coating layers, wherein a second coating layer comprising at least one of a first colour-imparting base lacquer coating medium and a first effect-imparting base lacquer coating medium is applied wet-into-wet to the first coating layer obtained by electrophoretic deposition, and the first and second coating layers thus obtained are stoved jointly, whereupon a third coating layer comprising at least one of a second colour-imparting base lacquer coating medium and a second effect-imparting base lacquer coating medium is applied and a fourth coating layer comprising a clear lacquer coating medium is applied wet-into-wet thereto and the third and fourth coating layers are stoved jointly, wherein the total dry coat thickness of the second and third coating layers produced from the base lacquer coating media is between 15 and 40 μm and the proportion of the second coating layer is between 20 and 50% of the total dry coat thickness of the second and third coating layers.

2. A process according to claim 1, wherein the total dry coat thickness of the second and third coating layers produced from the base lacquer coating media is between 20 and 35 $\mu$m.

3. A process according to claim 1, wherein a proportion of the second coating layer to the total dry coat thickness of the second and third coating layers produced from the base lacquer coating media is between 25 and 40% of the total dry coat thickness of the second and third coating layers.

4. A process according to claim 1, wherein base lacquer coating media, the colour tones of which approximate to each other, or which are the same, are used for production of the second and third coating layers.

5. A process according to claim 1, wherein base lacquer coating media which contain the same binder vehicles and optionally the same crosslinking agents are used for production of the second and third coating layers.

6. A process according to claim 5, wherein base lacquer coating media are used in which the binder vehicles and the crosslinking agents which optionally exist are present in the same quantity or the quantitative range of variation of the binder vehicles and of the crosslinking agents which are optionally present in the solid resin composition is less than 30% with respect to their relative proportions by weight in each case.

7. A process according to claim 1, wherein an aqueous base lacquer coating medium is used in each case for the second and third coating layers.

8. A process according to claim 1, wherein for production of the second coating layer an aqueous base lacquer coating medium is used which is obtained from use or from at least partial use of overspray arising during production of the third coating layer.

9. A process according to claim 1, used for multi-layer coating of motor vehicle bodies or parts thereof.

10. Motor vehicle bodies or parts thereof having a multi-layer coating obtained by a process of claim 1.

* * * * *